US006964614B1

(12) United States Patent
Tsai

(10) Patent No.: US 6,964,614 B1
(45) Date of Patent: Nov. 15, 2005

(54) RIDING DEVICE

(75) Inventor: Shih-Chang Tsai, Tainan (TW)

(73) Assignee: Tonic Fitness Technology, Inc., Tainan Hsien (TW)

( * ) Notice: Subject to any disclaimer, the term of this patent is extended or adjusted under 35 U.S.C. 154(b) by 23 days.

(21) Appl. No.: 10/972,418

(22) Filed: Oct. 26, 2004

(51) Int. Cl.[7] ..... A63G 31/06
(52) U.S. Cl. ..... 472/58; 472/96; 434/247
(58) Field of Search ..... 472/58, 59, 95, 472/96, 100, 101, 130; 434/29, 55, 247

(56) References Cited

U.S. PATENT DOCUMENTS 3,494,052 A * 2/1970 Corlyon ..... 434/55
3,997,979 A * 12/1976 Turner ..... 472/29
4,584,896 A * 4/1986 Letovsky ..... 74/490.1
5,623,878 A * 4/1997 Baxter et al. ..... 104/85
6,027,342 A * 2/2000 Brown ..... 434/55
6,095,926 A * 8/2000 Hettema et al. ..... 472/59
6,162,058 A * 12/2000 Yang ..... 434/55
6,283,757 B1 * 9/2001 Meghnot et al. ..... 434/33
6,315,673 B1 * 11/2001 Kopera et al. ..... 472/60
6,402,626 B1 * 6/2002 Beaty ..... 472/96
6,866,594 B2 * 3/2005 Greenwood ..... 473/422

* cited by examiner

*Primary Examiner*—Kien Nguyen
(74) *Attorney, Agent, or Firm*—Bacon & Thomas PLLC

(57) ABSTRACT

A riding device includes an intermediate base pivotally assembled on a bottom base and having the opposite ends respectively provided with a front and a rear vertical spindle. The front spindle has each end fixed with a crank, and the rear spindle has each end movably connected with a swing arm. The cranks and the swing arms have their upper ends respectively connected with four feet of a seat plate. A transmission unit fixed on the intermediate base includes a motor for driving a first, a second and a third gear to rotate. The third gear is secured on the front spindle. A pull rod has its upper end connected with the second gear by a universal bearing and its lower end connected with the bottom base. When the motor started, the seat plate can be actuated by interaction to swing back and forth, up and down and left and right.

5 Claims, 12 Drawing Sheets

RIDING DEVICE

BACKGROUND OF THE INVENTION

1. Field of the Invention

This invention relates to a riding device, particularly to one able to simulate the movements of horse riding, having excellent effect on a user's health.

2. Description of the Prior Art

Generally, a rowing apparatus, a walking apparatus, a stationary bike and a riding device are fitness equipment having function of simulation. The riding device has the following advantages.

1. It has functions of consuming a user's superfluous calories and helping a person to keep fit.

2. The natural and regular movements of horse riding is able to improve such conditions as sore waist, aching back, head ache, stiff neck and shoulder muscle tautness.

3. It helps to relax a person's muscles after he works for a long time and suffers from fatigue.

4. It has function of massaging a person's internal organs by means of vibration.

5. It has function of eliminating the superfluous flesh of a user's lower abdomen and beautifying a user's buttocks.

Therefore, riding devices for simulating the movements of horse riding have been developed, such as the one disclosed in a Taiwan patent No. 1220389 (Japan patent application No. 2003-010291).

SUMMARY OF THE INVENTION

The objective of the invention is to offer a riding device having function of simulating the movements of horse riding, able to swing back and forth, swinging up and down and swinging left and right obliquely.

The riding device in the present invention includes an intermediate base having its front and rear end pivotally connected with a bottom base by a pivot shaft. The intermediate base has its front and rear ends respectively and pivotally provided with a front spindle and a rear spindle respectively perpendicular to the intermediate base. The front spindle has its opposite ends respectively fixed with a crank, and the rear spindle has its opposite ends respectively and movably connected with a swing arm. The two cranks and the two swing arms of the intermediate base are respectively and pivotally connected with four feet of a seat plate positioned over the intermediate base. A transmission unit fixed on the intermediate base is provided with a motor for driving a first, a second and a third gear to rotate. The third gear is fixed on the front spindle for driving the front spindle to rotate. The second gear that is larger than the third gear has an eccentric portion of its shaft pivotally connected with a pull rod by a universal bearing. The pull rod is adjustable in length and has its lower end connected with the bottom base. When the motor is started, the third gear will be driven to actuate the front spindle and the cranks to rotate synchronously, and the swing arms will be actuated to shift and make the seat plate to swing back and forth and swing up and down. When actuated to rotate, the second gear that is pulled and restricted by the pull will actuate the seat plate, which has the pivotal shaft of the intermediate base acting as a pivot, to move left and right obliquely, obtaining effect of simulating the movements of horse riding.

BRIEF DESCRIPTION DRAWINGS

This invention will be better understood by referring to the accompanying drawings, wherein.

Figure 11:
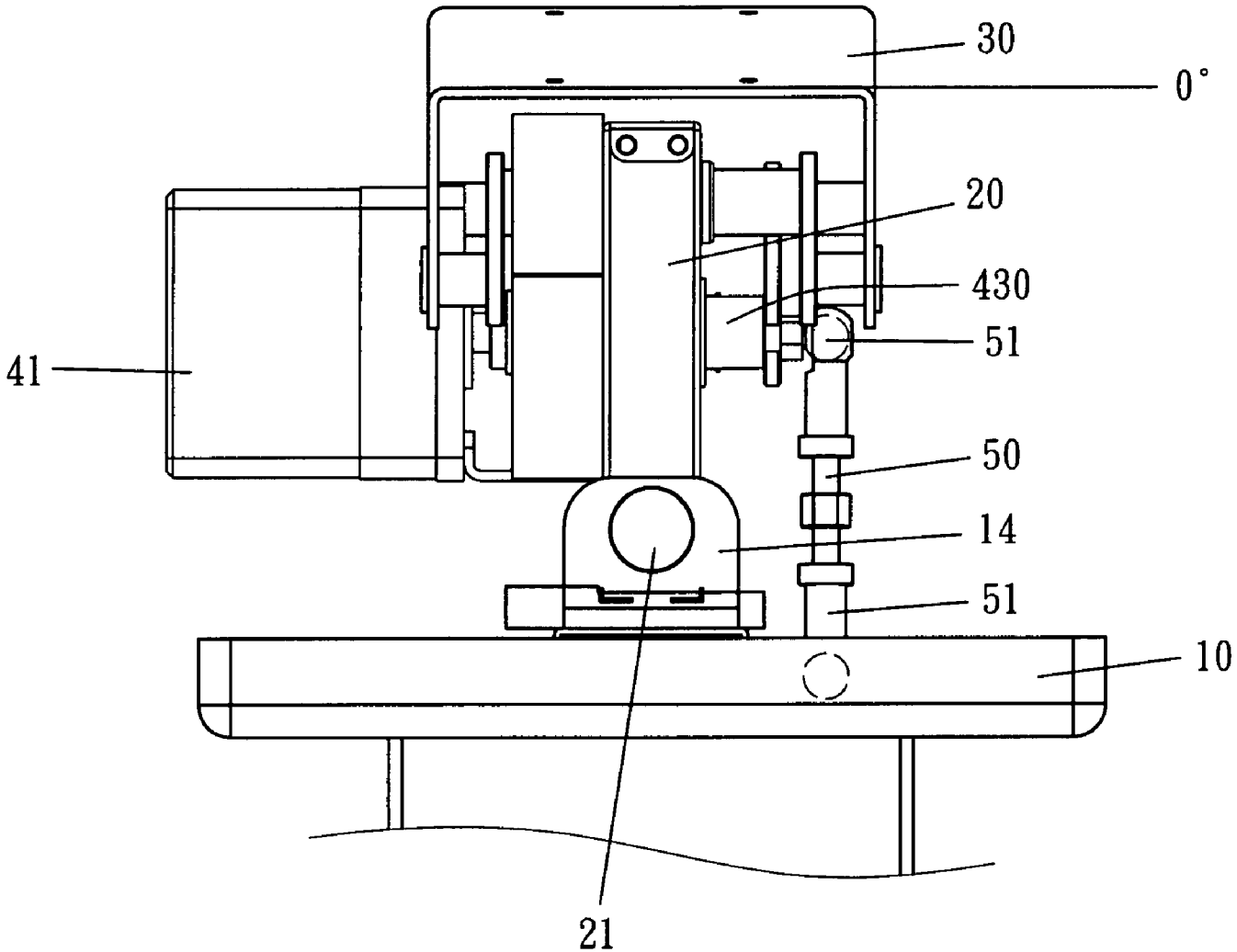
Figure 12:
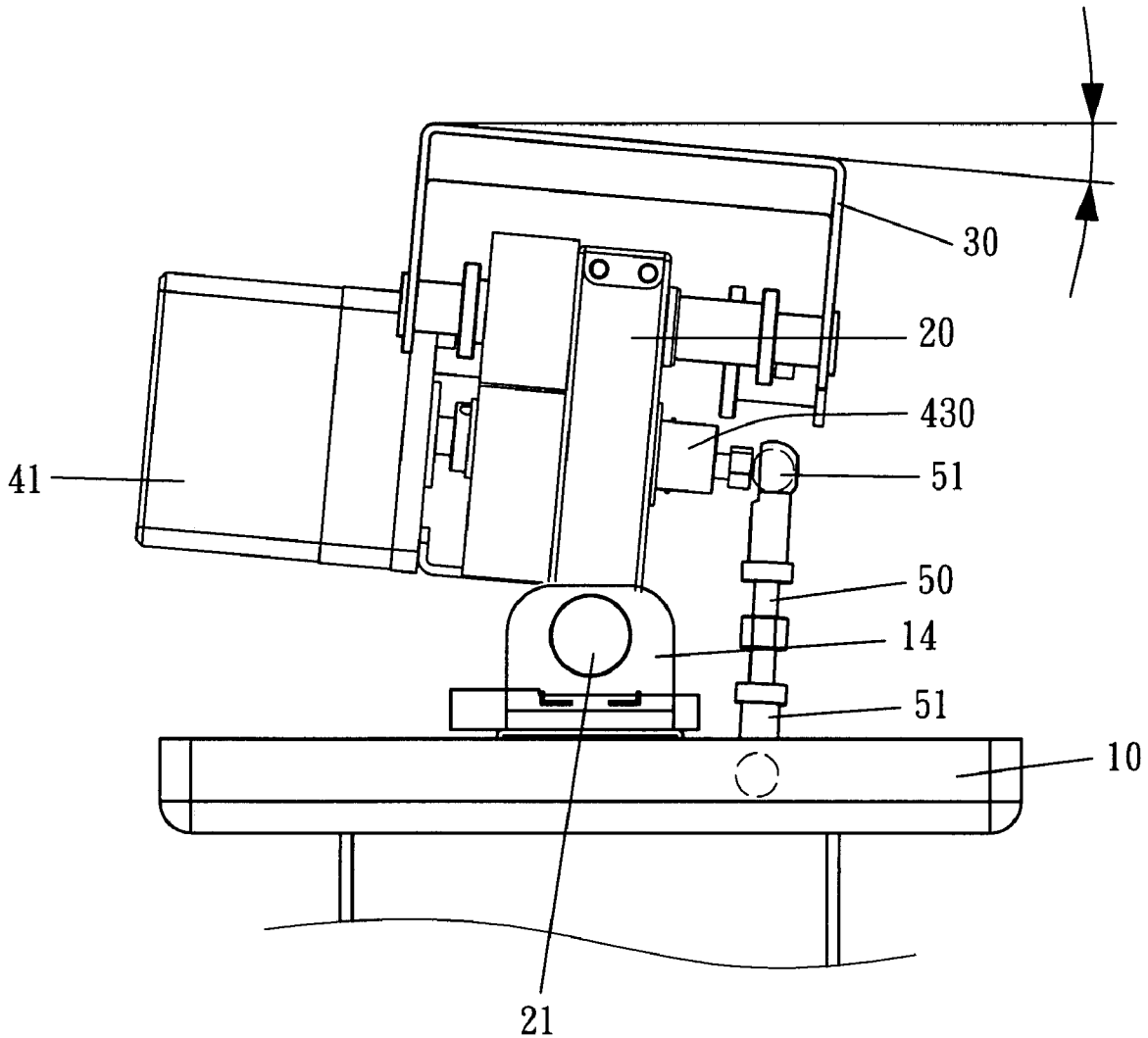

FIG. 11 is a cross-sectional view of the riding device in the present invention, showing that the seat plate is actuated to swing left and right obliquely when the shaft 430 of the second gear is rotated for 180 degrees: and FIG. 12 is a cross-sectional view of the riding device in the present invention, showing that the seat plate is actuated to swing left and right obliquely when the shaft 430 of the second gear is rotated for 270 degrees.

DETAILED DESCRIPTION OF THE PREFERRED EMBODIMENT

A preferred embodiment of a riding device in the present invention, as shown in FIGS. 1 to 4, includes a bottom base 10, an intermediate base 20, a seat plate 30, a transmission unit 40 and a pull rod 50 combined together.

The bottom base 10 has its four corners respectively provided with a guidepost 11 extending downward and having its outer side pivotally fitted with guiding rollers 12. Thus, when the four guide posts 11 are inserted in a bottom frame 13, the guiding rollers 12 on the guide posts 11 will push against the inner wall of the bottom frame 13 and can be driven by a driving machine to roll and actuate the bottom base 10 to move up and down and adjust it in height so as to suit riders of different heights. Further, the bottom base 10 has the left and the right side of its topside respectively fixed with an L-shaped combining plate 14.

Figure 2:
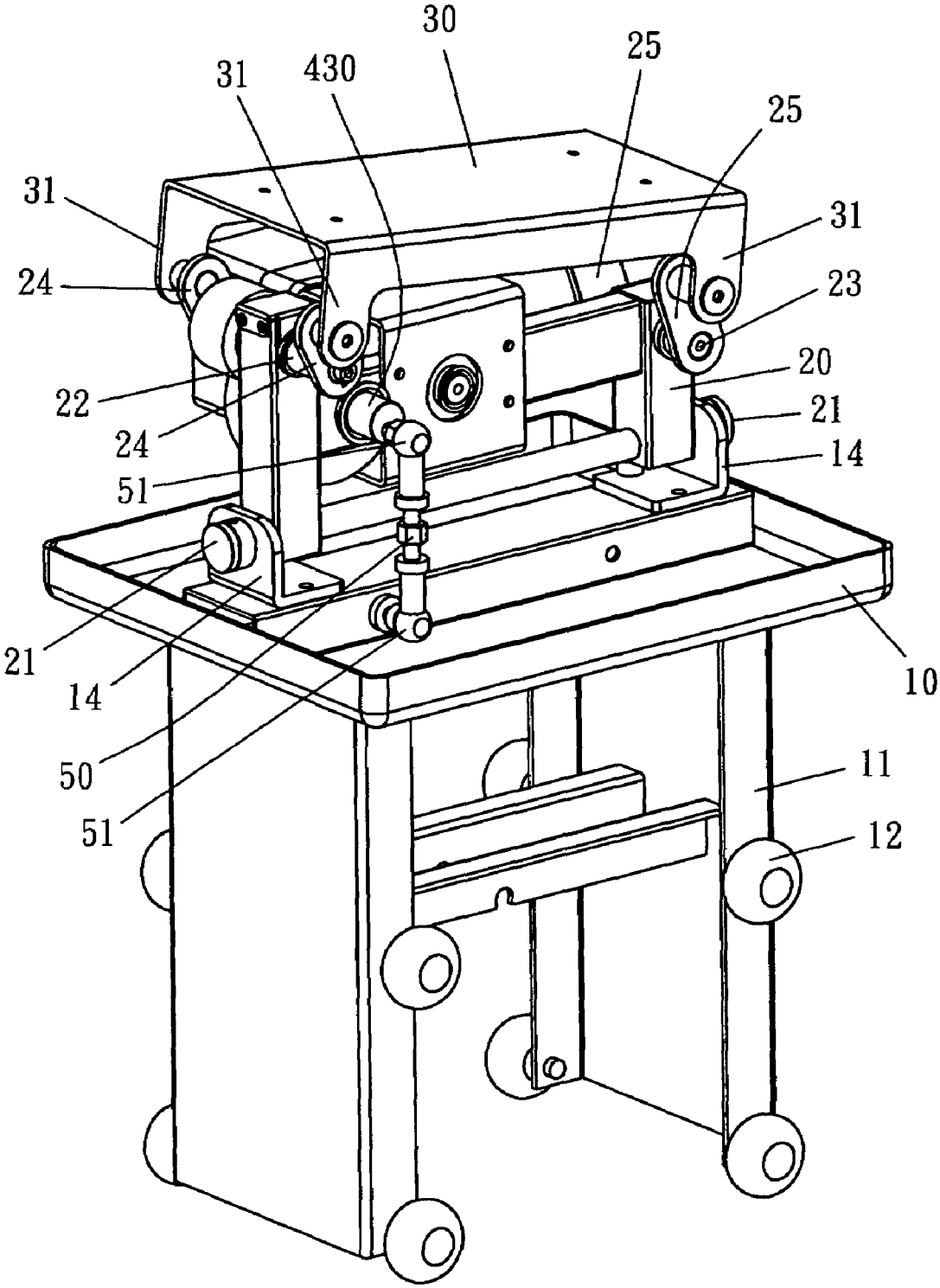
FIG. 2 is a second perspective view of the riding device in the present invention.
Figure 3:
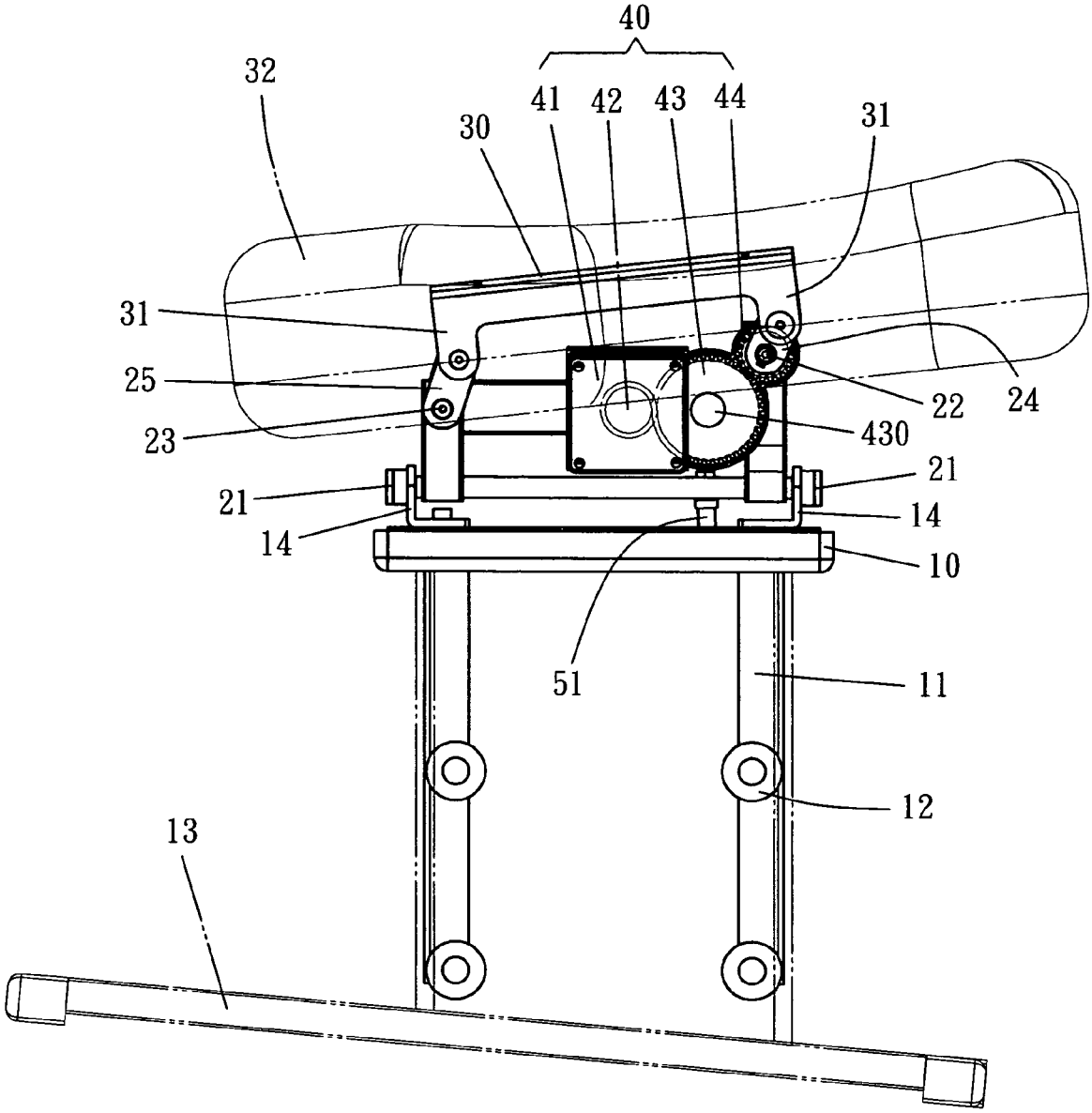
FIG. 3 is a side cross-sectional view of the riding device in the present invention.

The intermediate base 20 is assembled on the topside of the bottom base 10, having its front and rear ends pivotally combined with the combining plates 14 of the bottom base 10 by a pivotal shaft 21, as shown in FIGS. 2 and 3. The intermediate base 20 further has its upper front and rear ends respectively and pivotally provided with a front spindle 22 and a rear spindle 23 perpendicular to the intermediate base 20, as shown in FIGS. 2 and 3, with the opposite ends of the front and the rear spindle 22, 23 respectively positioned at the opposite sides of the intermediate base 20. The front spindle 22 has its opposite ends respectively fixed with a crank 24, and the rear spindle 23 has its opposite ends respectively and movably connected with a swing arm 25.

Figure 1:
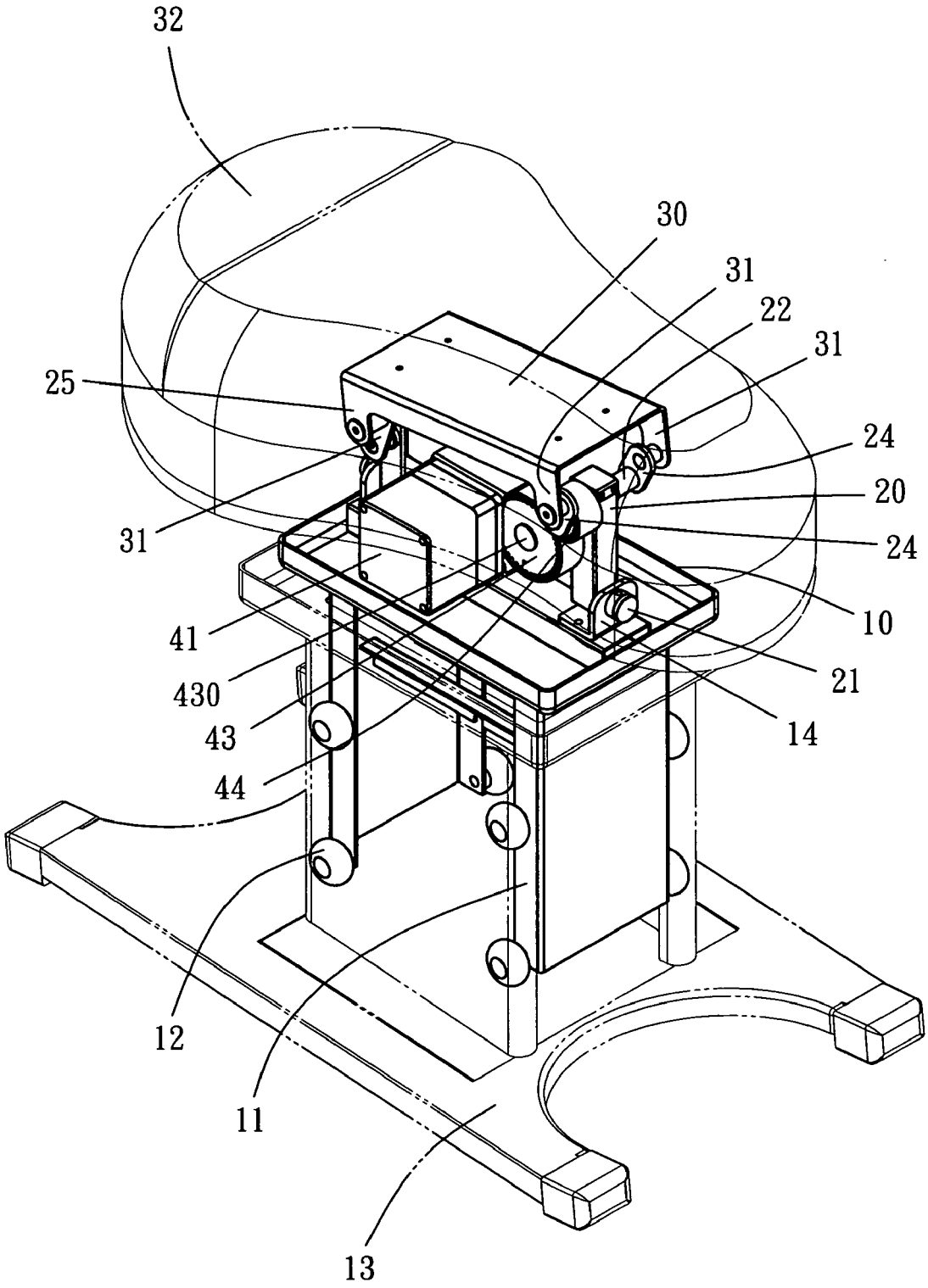
FIG. 1 is a first perspective view of a riding device in the present invention.

The seat plate 30 positioned over the intermediate base 20 has its four corners respectively formed integral with a connecting foot 31 extending downward. The two front connecting feet 31 of the seat plate 30 are respectively and pivotally connected with the two cranks 24, while the two rear connecting feet 31 of the seat plate 30 are respectively and pivotally connected with the two swing arms 25. The seat plate 30 further has a cushion 32 firmly fitted on the topside of the seat plate 30 for a rider to sit thereon, as shown in FIGS. 1, 3 and 4.

The transmission unit 40 fixed on the intermediate base 20, as shown in FIG. 3, is provided with a motor 41 having a rotating shaft for driving a first gear 42 to rotate. The first gear 42 is meshed with a second gear 43 that is meshed with a third gear 44, and the gear ratio between the second and the third gear 43, 44 is two to one. The shaft of the third gear 44 is the front spindle 22, which acts as a driving shaft for driving the cranks 24 to rotate.

Figure 4:
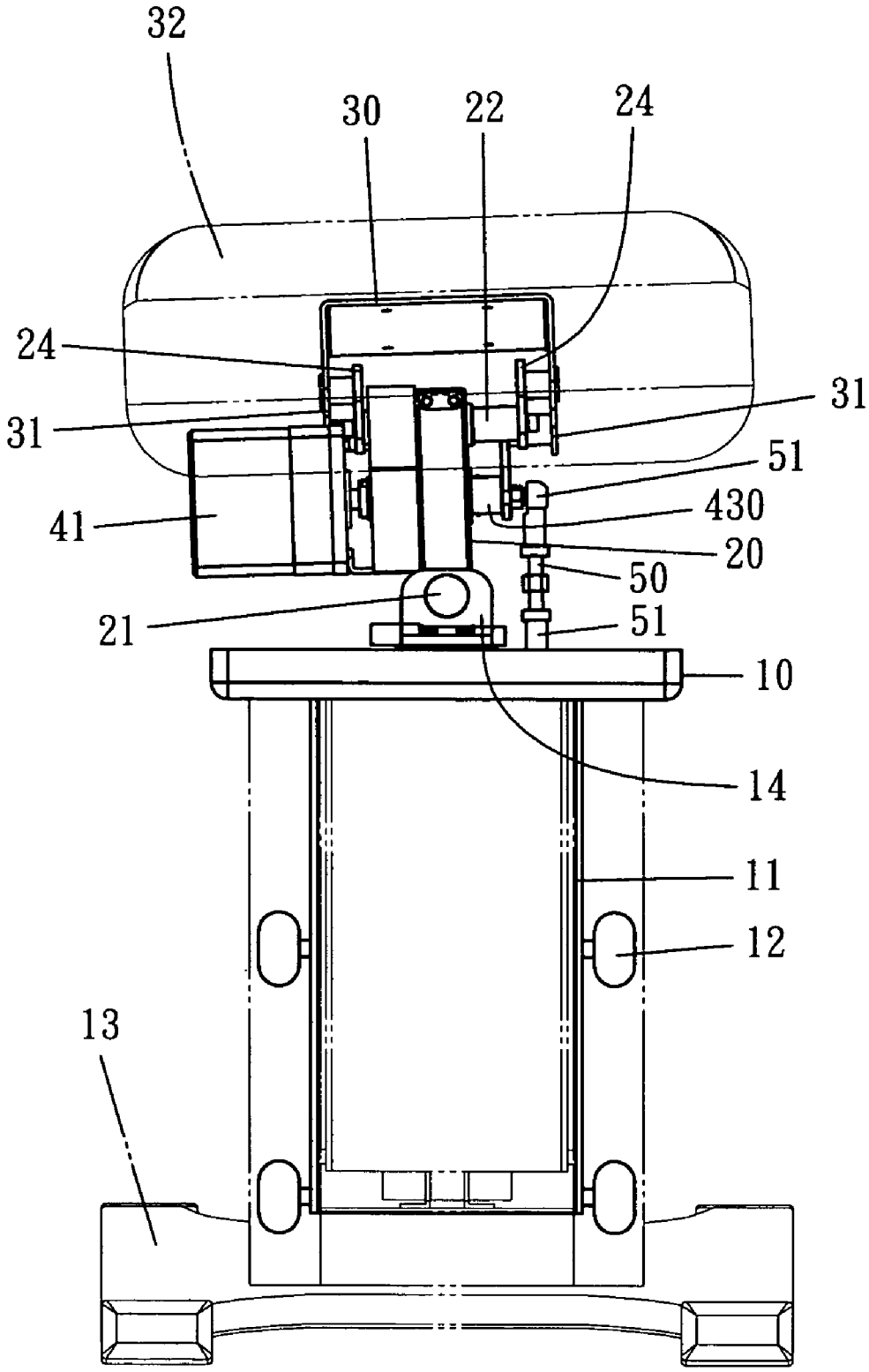
FIG. 4 is a cross-sectional view of the riding device in the present invention.
Figure 5:
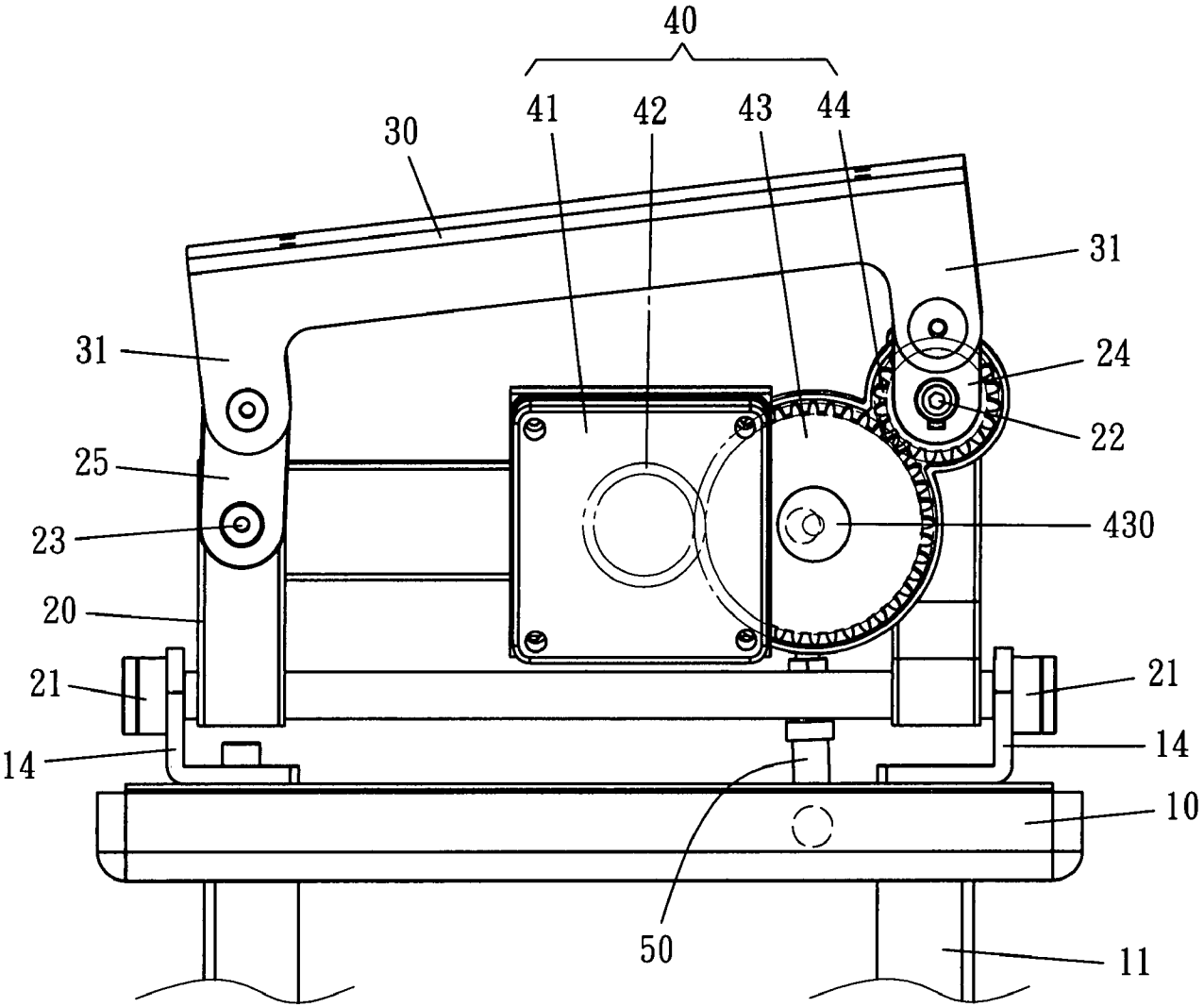
FIG. 5 is a side cross-sectional view of the riding device in the present invention, showing that the seat plate is actuated to swing back and forth and swing up and down when the front spindle is rotated for zero degree.
Figure 6:
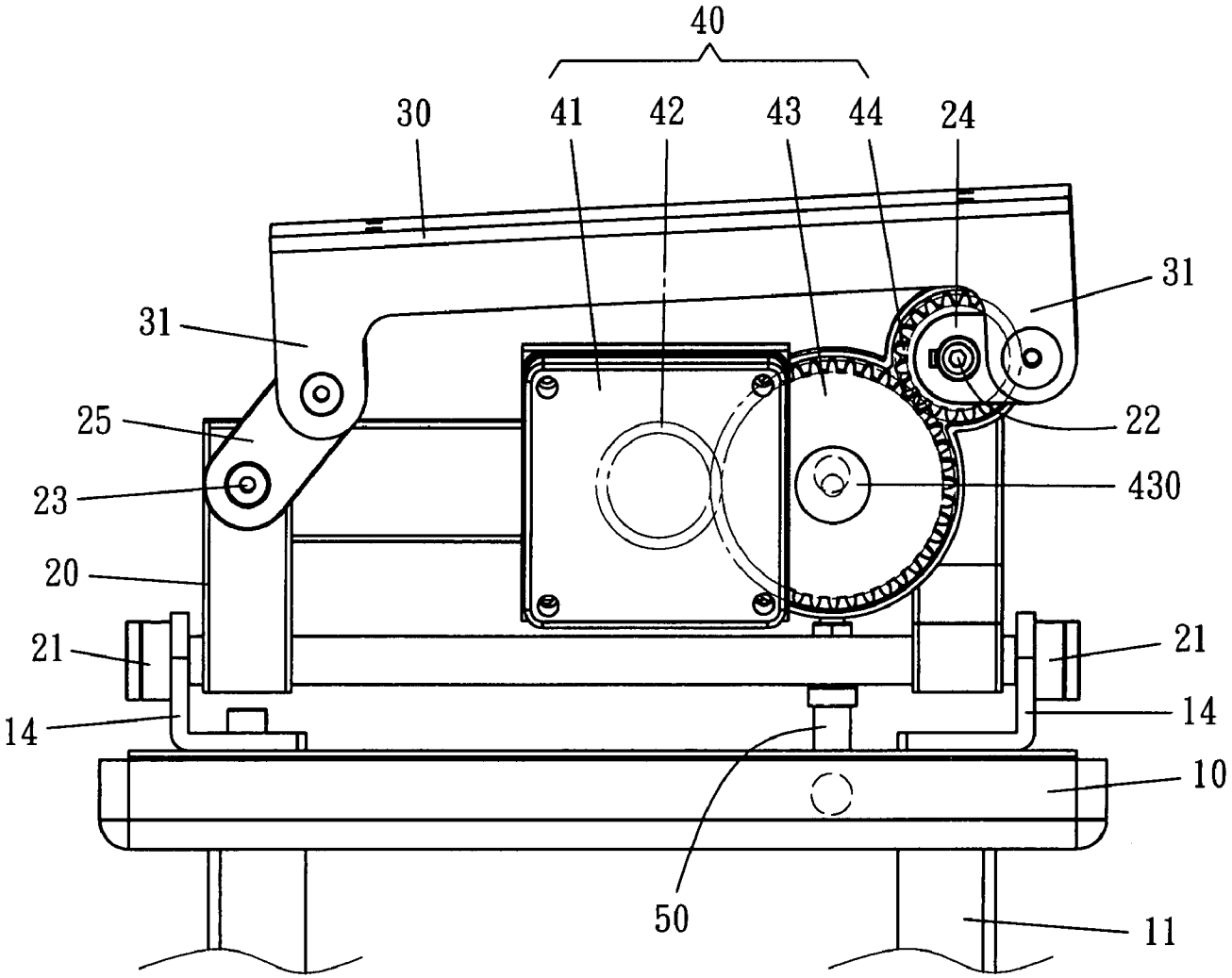
FIG. 6 is a side cross-sectional view of the riding device in the present invention, showing that the seat plate is actuated to swing back and forth and swing up and down when the front spindle is rotated for 90 degrees.
Figure 7:
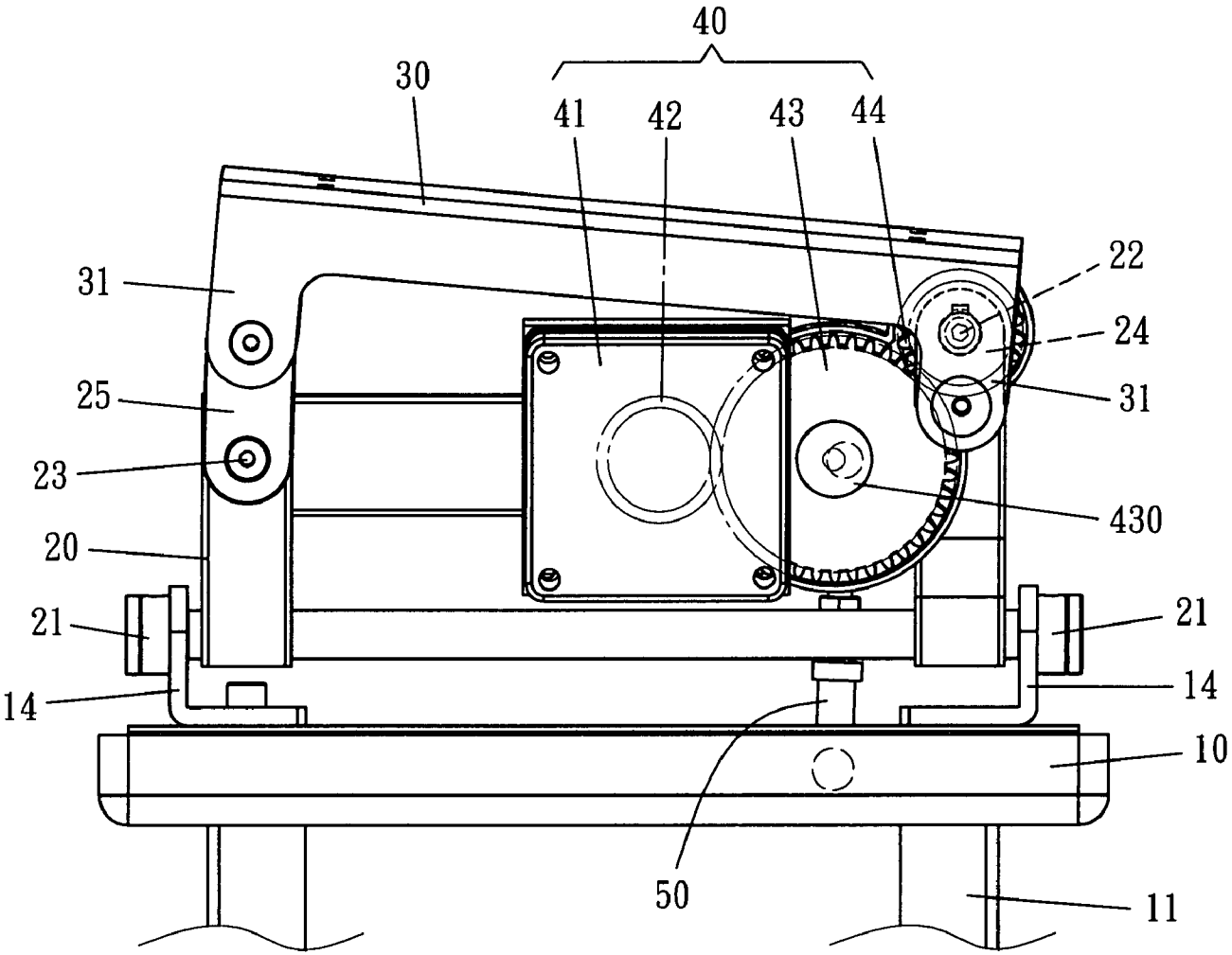
FIG. 7 is a side cross-sectional view of the riding device in the present invention, showing that the seat plate is actuated to swing back and forth and swing up and down when the front spindle is rotated for 180 degrees.
Figure 8:
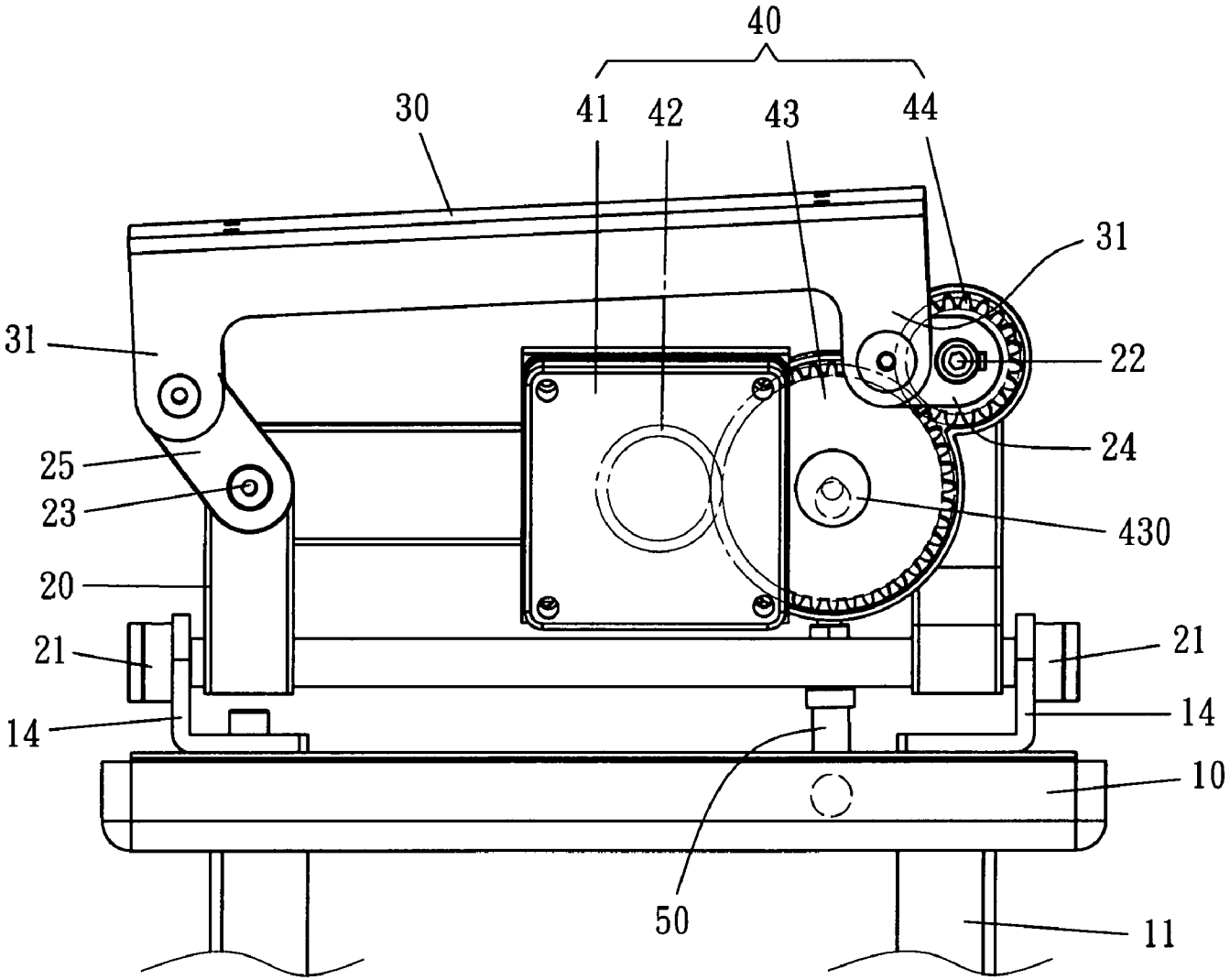
FIG. 8 is a side cross-sectional view of the riding device in the present invention, showing that the seat plate is actuated to swing back and forth and swing up and down when the front spindle is rotated for 270 degrees.
Figure 9:
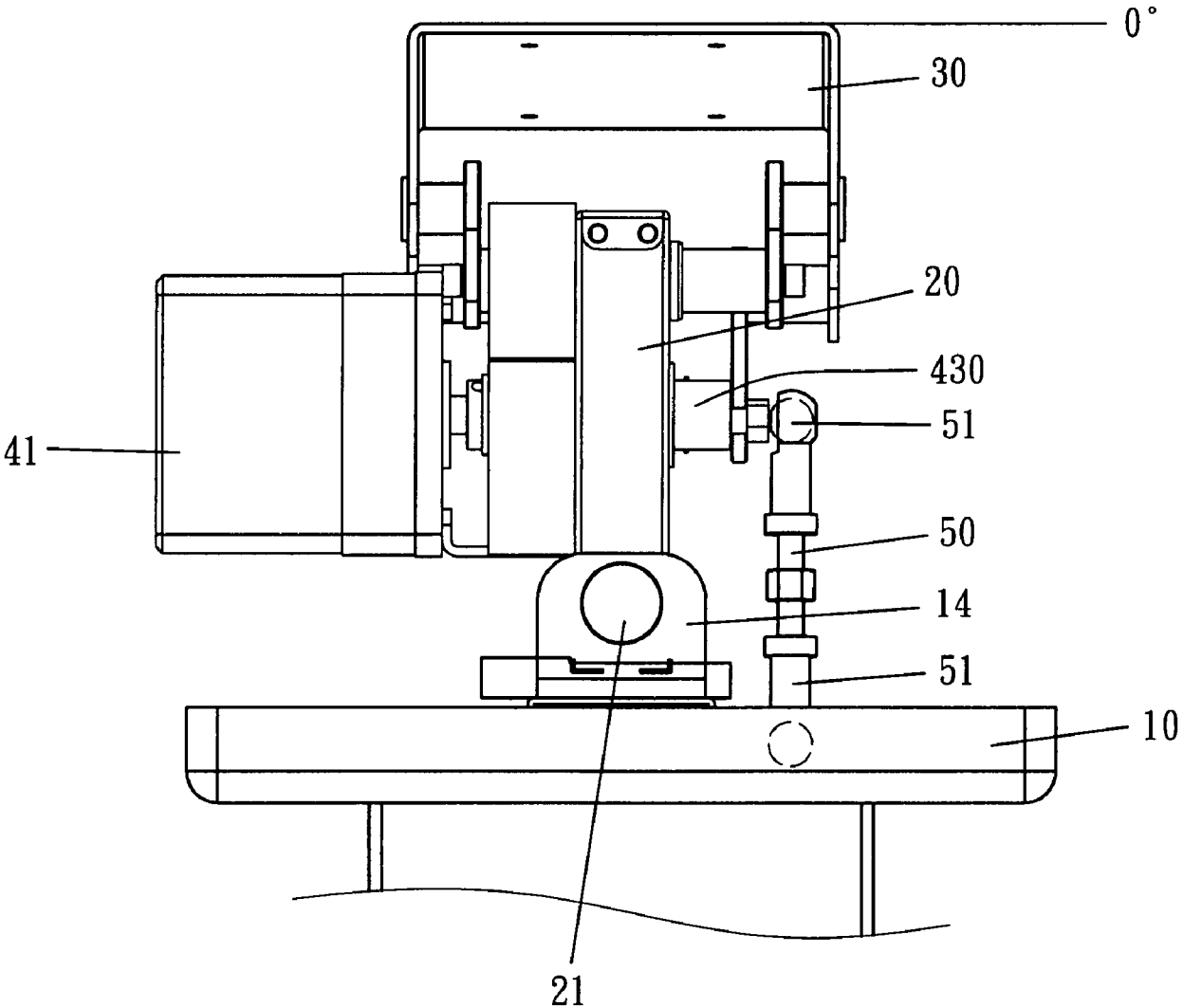
FIG. 9 is a cross-sectional view of the riding device in the present invention, showing that the seat plate is actuated to swing left and right obliquely when the shaft of the second gear is rotated for zero degree.
Figure 10:
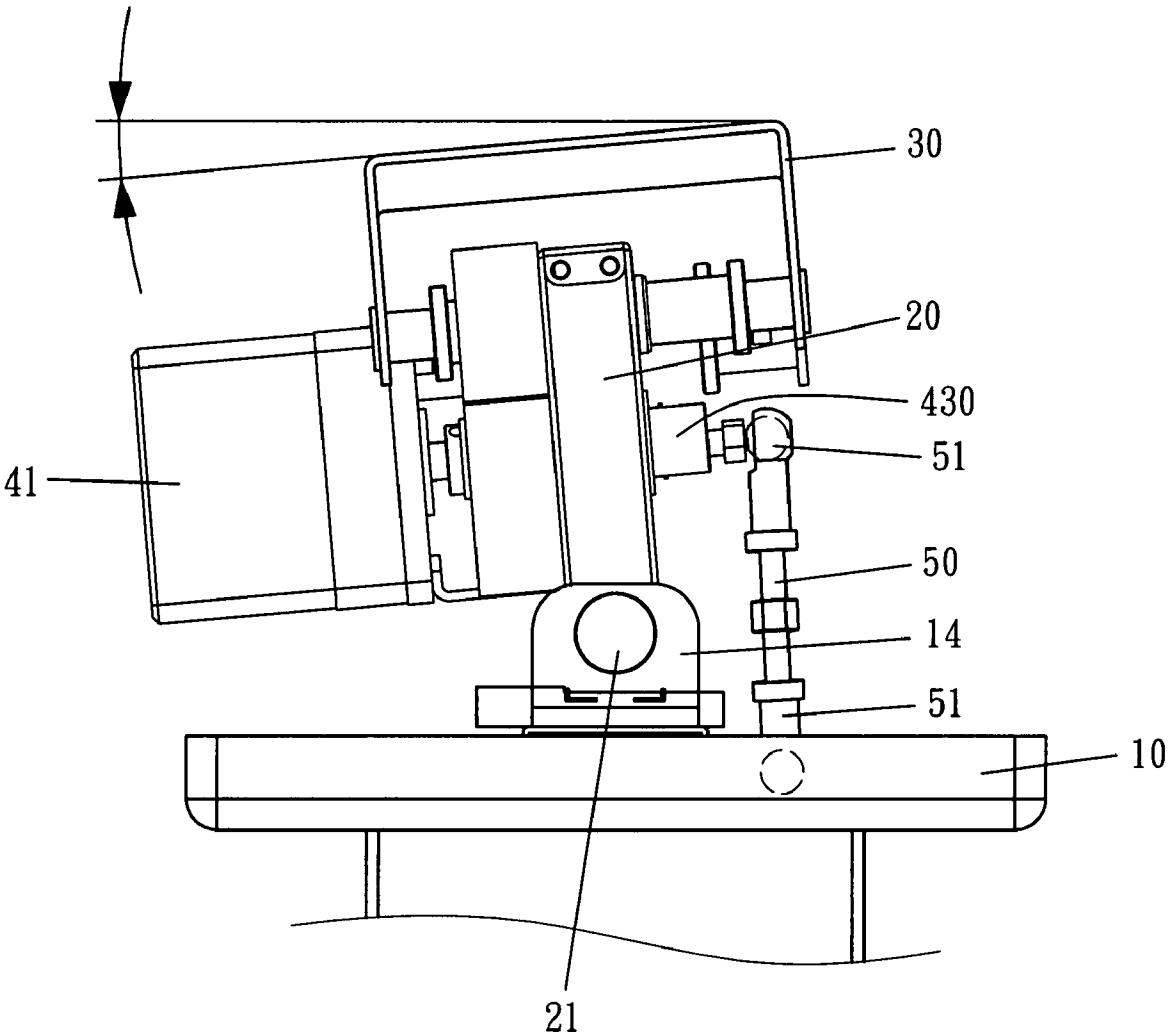
FIG. 10 is a cross-sectional view of the riding device in the present invention, showing that the seat plate is actuated to swing left and right obliquely when the shaft of the second gear is rotated for 90 degrees.

The pull rod 50 adjustable in length has its upper and lower end respectively fitted with a universal bearing 51, its upper end connected with an eccentric portion of the shaft 430 of the second gear 43 and its lower end connected with a positioning portion of the bottom base 10, as shown in FIGS. 2 and 4.

In operating and using, as shown in FIGS. 5 to 12, the riding device of this invention can be driven to produce different states of movements described as follows.

1. A state of swinging back and forth and swing up and down: When the motor 41 is started, the first, the second and the third gear 42, 43, 44 will be driven to rotate synchronously, and the front spindle 22 and the two cranks 24 will be rotated together with the third gear 44. The two cranks 24 have their upper ends respectively and pivotally connected with the two front connecting feet 31 of the seat plate 30, which has its two rear connecting feet 31 respectively and pivotally connected with the two swing arms 25 of the rear spindle 23. Therefore, with the front spindle 22 acting as a driving shaft and the swing arms 25 acting as driven ends swinging together with the front spindle 22, the seat plate 30 can be actuated to swing back and forth. When the front spindle 22 is rotated for zero degree, 90 degrees, 180 degrees or 270 degrees, the seat plate 30 will be actuated to swing at different angles, as shown in FIGS. 5 to 8, and when the cranks 24 are driven to rotate at different angles accordingly, the seat plate 30 can be actuated to swing back and forth and swing up and down in different ways at the same time. Thus, when the third gear 44 is rotated for one circle, the seat plate 30 will swing back and forth and swing up and down for one round.

2. A state of swinging left and right obliquely, as shown in FIGS. 9 to 12: The second gear 43 has an eccentric portion of its shaft 430 connected with the upper end of the pull rod 50, which has its lower end connected with the bottom base and its upper and lower end respectively provided with the universal bearing 15, letting the second gear 43 pulled and restricted in position by the pull rod 50. Therefore, when the second gear 43 is rotated, the intermediate base 20 and the seat plate 30, which have the pivotal shaft 21 acting as a fulcrum, will swing left and right obliquely. Thus, when the second gear 43 is rotated for a circle, the seat plate 30 will be actuated to swing left and right obliquely for one round. In addition, since the gear ratio between the second and the third gear 43, 44 is two to one, when the second gear 43 is rotated for one circle, the third gear 44 will be rotated for two circles. Therefore, when the seat plate 30 swings back and forth once, it will swing to one side obliquely, and when the seat plate 30 swings back and forth a second time, it will swing to the other side obliquely. By so designing, the seat plate 30 can be driven to swing back and forth, swing up and down and swing left and right obliquely at the same time, and the extent of swinging left and right can be adjusted by adjusting the length of the pull rod 50.

To sum up, the riding device of this invention can be driven to carry out different movements of swinging back and forth, swinging up and down and swinging left and right obliquely to let a rider feel as if he were on horseback to take exercise, having verisimilitude and excellent effectiveness on a user's health.

While the preferred embodiment of the invention has been described above, it will be recognized and understood that various modifications may be made therein and the appended claims are intended to cover all such modifications that may fall within the spirit and scope of the invention.

I claim:

1. A riding device comprising:

A bottom base able to be placed on a plane surface:

An intermediate base assembled on said bottom base, said intermediate base having its front and rear end pivotally combined with said bottom base, said intermediate base having the front and rear end of its topside respectively and pivotally provided with a front spindle and a rear spindle perpendicular to said intermediate base, said front spindle having its opposite ends respectively fixed with a crank for moving together, said rear spindle having its opposite ends respectively and movably connected with a swing arm:

A seat plate positioned over said intermediate base, said seat plate having its four corners respectively formed integral with a connecting foot extending downward, said four connecting feet of said seat plate respectively and pivotally connected with the extending ends of said two cranks and said two swing arms, said seat plate having its topside fitted with a cushion for a rider to sit thereon:

A transmission unit secured on said intermediate base, said transmission unit provided with a motor for driving a first, a second and a third gear to rotate, said third gear secured on said front spindle for rotating together:

A pull rod having its upper end connected with an eccentric portion of the shaft of said second gear, said pull rod having its lower end connected with a positioning point of said bottom base, said pull rod having its upper and lower turning end respectively provided with a universal bearing, and Said motor stated to drive said third gear and said front spindle to rotate, said third gear and said front spindle driving said cranks to swing, said cranks actuating said seat plate to swing back and forth and swing up and down, said eccentric portion of said shaft of said second gear pulled and restrained by said pull rod, said second gear rotated to make said intermediate base and said seat plate swing left and right obliquely by a pivotal shaft that connects said intermediate base with said bottom base and acts as a pivot.

2. The riding device as claimed in claim 1, wherein the gear ratio between said second and said third gear is two to one.

3. The riding device as claimed in claim 1, wherein said pull rod is adjustable in length for adjusting the left and the right slanting extent of said seat plate.

4. The riding device as claimed in claim 1, wherein said bottom base has the front and rear end of its topside respectively provided with an L-shaped combining plate facing each other, and said intermediate base has its front and rear end respectively and pivotally connected with said two combining plates by said pivotal shaft. 5.

5. The riding device as claimed in claim 1, wherein said bottom base has its four corners respectively provided with a guide post extending downward and having the outer side fitted with guiding rollers, said four guide posts inserted in a bottom frame, said guiding rollers of said guide posts pushing against the inner wall of said bottom frame and driven to roll by a driving machine, said bottom base thus able to be moved up and down so as to suit riders of different heights.

* * * * *